United States Patent [19]

Alberghini

[11] 4,241,839

[45] Dec. 30, 1980

[54] BASE-CUP FOR ASSURING VERTICAL ALIGNMENT OF SEMI-HEMISPHERICALLY BOTTOMED BOTTLES

[75] Inventor: Alfred C. Alberghini, Dunwoody, Ga.

[73] Assignee: Sewell Plastics, Inc., Atlanta, Ga.

[21] Appl. No.: 66,450

[22] Filed: Aug. 14, 1979

[51] Int. Cl.[3] ..... B65D 23/00

[52] U.S. Cl. ..... 215/100 R; 29/453; 215/1 C; 215/12 R; 248/346; 248/359

[58] Field of Search ..... 215/1 C, 12 R, 100 R; 220/69; 29/453; 248/346, 346.1, 359

[56] References Cited

U.S. PATENT DOCUMENTS

| | | | |
|---|---|---|---|
| 3,927,782 | 12/1975 | Edwards | 215/12 R X |
| 3,948,404 | 4/1976 | Collins | 215/12 R X |
| 4,082,220 | 4/1978 | Guest | 215/12 R X |
| 4,138,026 | 2/1979 | Conklin | 215/12 R |

*Primary Examiner*—Donald F. Norton

*Attorney, Agent, or Firm*—Quaintance, Murphy & Richardson

[57] ABSTRACT

A base-cup for supporting a bottle in an upright position is disclosed for use with a bottle having a semi-hemispherical bottom and having a radial indentation in the lower portion of its otherwise generally cylindrical body. The base-cup includes a sole plate and a cylindrical side wall having an open top edge with an annular bead on the inside thereof, and a bottom edge smoothly merging into the sole plate. The base-cup also includes limit means projecting upward from the sole plate into the interior of the base-cup for preventing the over-insertion of the bottle into the base-cup. Preferred embodiments of the limit means are illustrated which include circumferentially equally spaced and radially extending fillet webs joining the side wall to the sole plate, and upwardly projecting rings situated approximately midway between the center of the sole plate and the point at which the side wall smoothly merges into the sole plate.

10 Claims, 12 Drawing Figures

BASE-CUP FOR ASSURING VERTICAL ALIGNMENT OF SEMI-HEMISPHERICALLY BOTTOMED BOTTLES

BACKGROUND OF THE INVENTION

1. Field of the Invention

This invention relates generally to plastic beverage containers and more particularly to containers for carbonated beverages and other pressurized products which are blow-molded so as to have a semi-hemispherical bottom, and most particularly to a base-cup attachment thereto for supporting the bottle in an upright position.

The specific improvement provided by the present invention is the existence of means within the base-cup for preventing the over-insertion of the bottle into the base cup thereby effectively assuring vertical alignment of the bottle.

2. Description of Prior Art

In recent years, blow-molded plastic bottles for containing carbonated beverages such as beer, colas, and the like have been developed which typically employ very thin wall sections and include a round or semi-hemispherical bottom for containing the internal pressure of the carbonated beverage. The presence of the semi-hemispherical bottom end of the bottle does not permit the bottle to stand upright on a shelf or table top without the addition of some auxillary base. The base has typically taken the form of a shallow cup having an inwardly projecting annular ring at the lip of the cup which engages an indentation present at a lower portion of the otherwise generally cylindrical body of the bottle. The term "semi-hemispherical" is intended to include any hemispherical-like shape including that of an elipsoid, a paraboloid, or other similar variant.

The line of inter-engagement between the annular ring at the lip of the supporting base-cup with the indentation in the side wall of the bottle body constitutes a reference line about which the body of the bottle expands axially when the bottle is sealed with a carbonated beverage inside. That is, the presence of the carbonation causes an elevation in the pressure within the bottle thereby causing the bottle to axially elongate. Thus, the base-cup must provide sufficient room for this axial elongation by maintaining a space of sufficient dimension between the bottom of the bottle in its unpressurized condition and the bottom of the base-cup. A failure to provide such a space causes the bottle to expand to such an extend as to press downward on the bottom of the base-cup and distort the base-cup into an unstable configuration.

If sufficient space is provided for this axially elongation, a further difficulty is presented, in that, the unpressurized or empty bottle can be inserted too far into the base-cup beyond the point of inter-engagement between the annular ring at the lip of the base-cup and the indentation in the bottle body. In the absence of this inter-engagement between the indentation and the annular ring of the cup, the bottle can become axially misaligned with respect to the cup so as to no longer stand in a perfectly upright position.

It is, therefore, an object of the present invention to provide a base-cup for use with a blow-molded plastic bottle of contemporary design which permits the axial expansion of the bottle under pressure, but prevents the over-insertion of the bottle into the base-cup thereby ensuring vertical alignment of the bottle and base-cup.

SUMMARY OF THE INVENTION

A base-cup constructed according to the present invention acts to support a bottle in an upright position, and intended for use with a bottle having a semi-hemispherical bottom and having a radial indentation in a lower portion of the otherwise generally cylindrical body. The base-cup itself generally includes a sole plate and a cylindrical side wall having an open top edge and a bottom edge smoothly merging into the sole plate. An annular bead is present on the inside of the top edge for engaging the radial indentation of the bottle body. There is further provided limit means projecting upward from the sole plate into the interior of the base-cup for preventing the over-insertion of the bottle into the base-cup significantly beyond the point of inter-engagement of the annular lip or bead and the bottle indentation.

This limit means is preferably formed as at least three circumferentially equally spaced and radially extending fillet webs joined to the side wall of the base-cup. The fillet webs can be solid or hollow. When the fillet webs are hollow, there typically is a corresponding hollow present in a lower portion of the side wall and in outer portion of the sole plate. The interior surface of each of the fillet web is preferably concave.

The base-cup can also include at least one vent hole in the sole plate. The vent hole is preferably positioned at the periphery of the sole plate where it merges smoothly with the bottom of the cylindrical side wall. In one preferred embodiment, the bottom edge of the side wall merging into the sole plate is lower than the center most portion of the sole plate. A centrally located, upwardly projecting dimple can also be provided in the sole plate.

In another embodiment, the limit means comprises a ring situated approximately half way between the center of the sole plate and the cylindrical side wall. The ring is hollow and there is a corresponding indentation on a lower surface of the sole plate. The ring can be upwardly and downwardly displaced with respect to the open top edge of the sidewall, the downward displacement causing a proportional downward and outward displacement of the sole plate periphery. A downward displacement can occur due to the axial elongation of the bottle under pressure, thereby maintaining stable support for the bottle in this condition. When the bottle was inserted into the base-cup itself, the force of insertion causes an upward and inward displacement of the sole plate periphery and limit means ring which in turn prevents over insertion of the bottle into the base-cup.

One advantage of the present invention is a base-cup which ensures vertical alignment of the bottle to which the base-cup is attached by preventing the over-insertion of the bottle into the base-cup. This feature is very important, inasmuch as axial misalignment between the base-cup and bottle results in both contents and bottle losses as well as expensive shut-downs in automated filling lines when the bottle is attempted to be filled. A further advantage provided by the present invention is overall bottle stability by providing a base-cup which permits appropriate axial elongation of the bottle to which the base-cup is attached without developing an unstable "rocker" condition. These and other features and advantages of the present invention will become more apparent from a consideration of the following description of the preferred embodiments of the invention.

DESCRIPTION OF PREFERRED EMBODIMENTS

Figure 1:
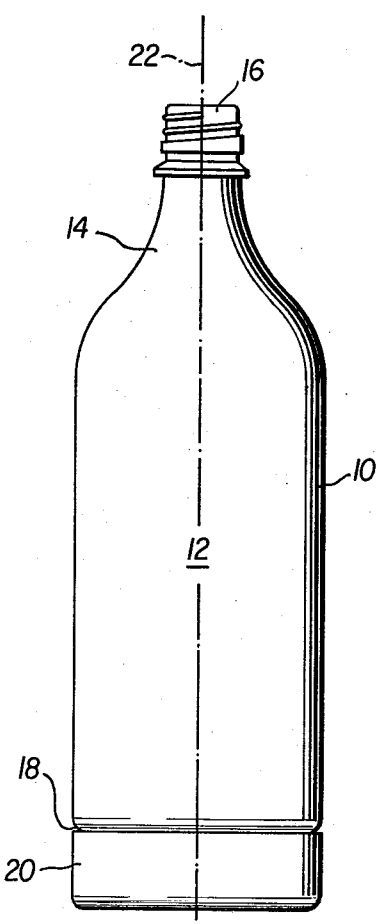
FIG. 1 PRIOR ART
FIG. 1 is an elevation view of a bottle and base-cup.

In FIG. 1, there is illustrated a bottle 10, with which the present invention can be employed, which is typically made of polythylene terephthalate (PET) or other material which has been blow-molded into the configuration illustrated. The bottle 10 has a generally cylindrical body 12 having a tapered neck 14 at the upper end thereof terminating in a finish 16 adapted to receive a threaded cap or other conventional closure. A radial indentation 18 is present at a lower extremity of the cylindrical body 12. A separate base-cup 20 is attached to the bottle 10 by means of a bead or annular rim which engages the indentation 18 of the bottle 10. Assuming that the bottle indentation 18 and base-cup 20 are appropriately formed and that the base-cup and bottle are correctly assembled, the base-cup assures a vertical alignment of the axis 22 of the bottle 10 so as to permit use of the combined bottle base-cup combination in automatic filling equipment previously used with glass bottle containers for the same purpose.

FIGS. 2–5 illustrate base-cups of the prior art, and further illustrate problems and difficulties encountered in the use of the prior art base-cups. As illustrated in FIGS. 2–5, the bottle 10 include a rounded or semi-hemispherical bottom 24, which prevents the bottle from being stably self-supporting on a flat, horizontal surface 26. Rather, the base-cup 20 is interposed so as to present a bottom structure which permits the upright vertical alignment of the bottle 10 with respect to the horizontal surface 26. The base-cups generally comprise a sole plate 28 and a cylindrical side wall 30 having an open top edge 32 and a bottom edge 34 smoothly merging into the sole plate 28. An annular bead 36 is included on the inside of the top edge 32 for engaging the radial indentation 18 on the body 12 of bottle 10.

Figure 4:
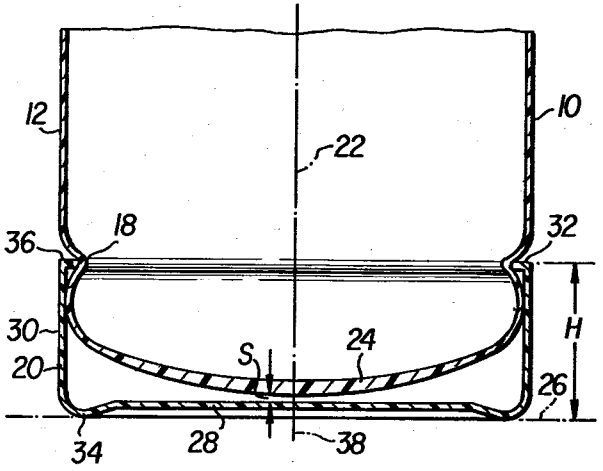
FIG. 4 PRIOR ART
FIGS. 2–5 are sectional views of prior art base-cups illustrating difficulties presented by the prior art.
Figure 2:
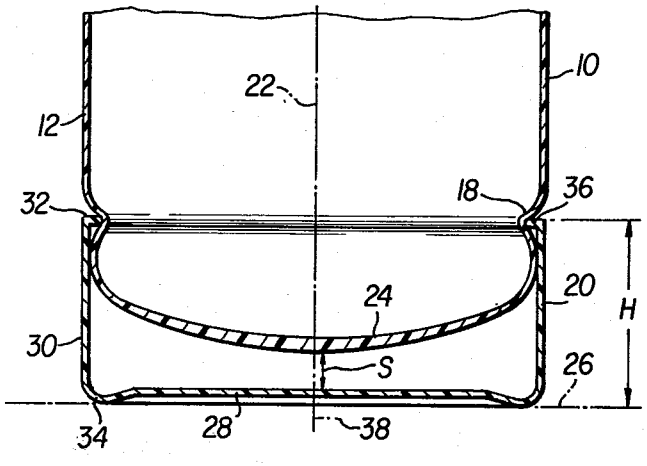
FIG. 2 PRIOR ART

The cylindrical side wall 30 may be constructed of varying height H as is illustrated in FIGS. 2 and 4. Assuming that the two base-cups illustrated in FIGS. 2 and 4 are employed with the same bottle, this results in a difference in the distance S representing the space between the bottle bottom 24 and the sole plate 28 of the base-cup. This space is necessary to permit the axial elongation of the bottle 10 which naturally occurs when the bottle is sealed containing a carbonated beverage. The pressure present on the inside of bottle 10 when containing a carbonated beverage such as soda water or beer is between 40 and 120 pounds per square inch and may upon occasion reach 200 pounds per square inch. The inter-engagement of the bead 36 with indentation 18 establishes a line of reference from which the bottle axially extends both upward and downward.

Figure 3:
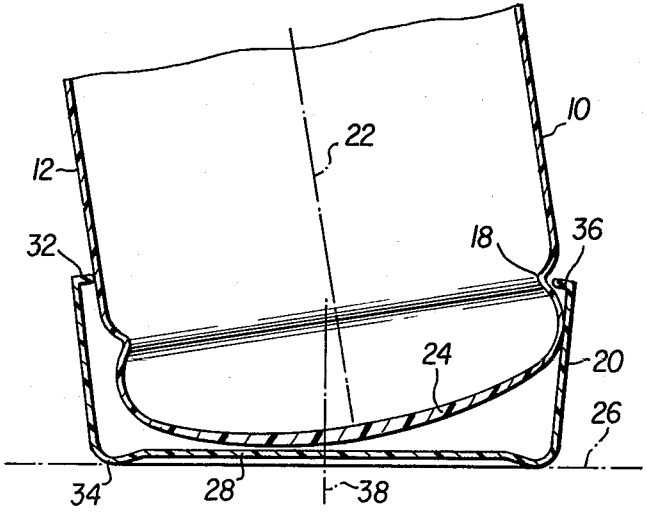
FIG. 3 PRIOR ART

If the space S provided to permit the axial elongation of the bottle is too great, then it is possible to over insert the bottle into the base-cup as illustrated in FIG. 3, generally resulting in an axial misalignment between the axis 22 of the bottle and the axis 38 of the base-cup. While the axes 22 and 38 of the bottle and base-cup will generally be aligned if indentation 18 and bead 36 are properly engaged one with the other, the over insertion of the bottle into the base-cup can, and typically does, result in this alignment.

Figure 5:
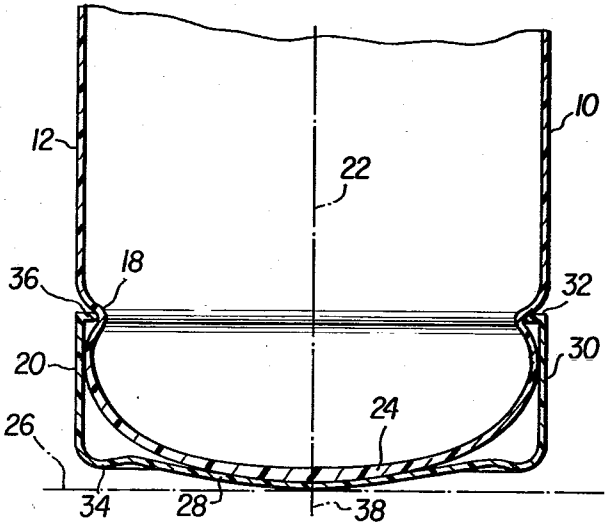
FIG. 5 PRIOR ART

While the over insertion can be prevented by adopting a lower height H for side wall 30, thereby minimizing distance S as illustrated in FIG. 4, this results in providing an insufficient space for bottle expansion. Thus, when the bottle does axially elongate, a round or rocker bottom condition is formed such as is illustrated in FIG. 5, where the bottle 10 is no longer stably supported by the base-cup 20, but rather is free to rock back and forth on the rounded sole plate 28 of the base-cup which has been distended into the illustrated position due to the internal pressure of the bottle 10.

Figure 6:
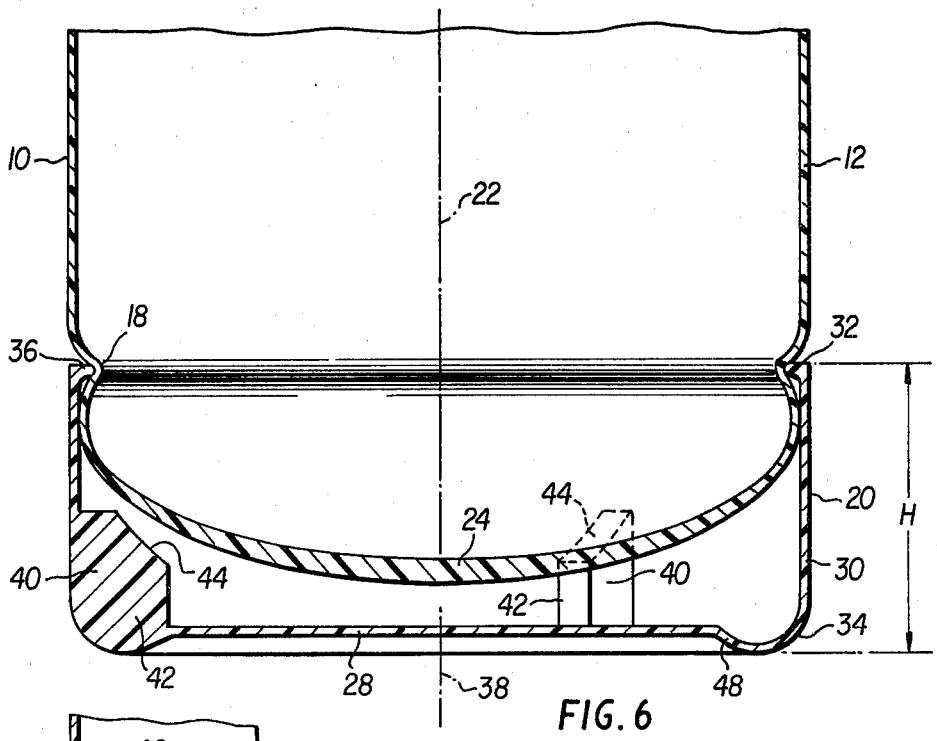
FIG. 6 is a sectional view of a preferred embodiment of this invention employing solid fillet web limit means.
Figure 7:
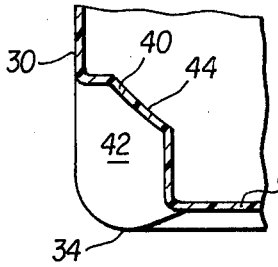
FIG. 7 is a partial sectional view of a base-cup similar to that illustrated in FIG. 6 with a hollow fillet web limit means.
Figure 8:
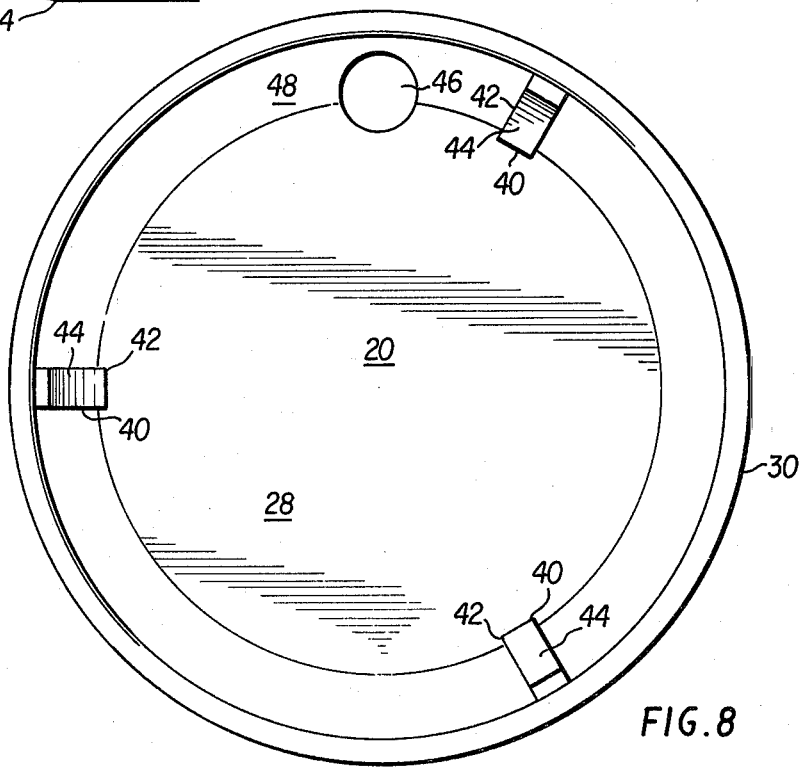
FIG. 8 is a plan view of the base-cup illustrated in FIG. 6 and/or 7.

A preferred embodiment of the present invention is illustrated in FIGS. 6, 7 and 8. There the base-cup 20 includes a sole plate 28, and a cylindrical side wall 30 of sufficient height H so as to permit the downward expansion of the semi-hemispherical bottle bottom 24 towards the sole plate 28, the height H being selected so as to prevent the rocker condition previously illustrated in FIG. 5. The side wall 30 has an open top edge 32 and a bottom edge 34 smoothly merging into the sole plate 28. The annular bead 36 is present on the inside of the top edge 32 and engages the radial indentation 18 of the bottle body 12. There is further provided limit means 40 projecting upward from the sole plate 28 into the interior of the base-cup 20 for preventing the over insertion of the bottle 10 into the base-cup 20. The limit means 40 comprises at least three circumferentially equally spaced and radially extending fillet webs 42 joining the side wall 30 to the sole plate periphery 48. The fillet webs 42 may be solid as illustrated in FIG. 6 or may be hollow as illustrated in FIG. 7. When hollow, there exists a hollow present in the lower portion of the side wall 30 and in an outer portion of the sole plate 28 corresponding to each fillet web 42. The interior surface 44 of the fillet web 42 is positioned so as to interact with a portion of the bottle bottom 24 and to prevent its over insertion. The interior surface 44 is preferably concave as illustrated. It will be appreciated that while at least three such fillet webs are illustrated in FIGS. 6 and 8, any number, for example six, may be employed to achieve the desired purposes.

The base-cup of the present invention can further include at least one vent hole 46 in the sole plate 28. The vent hole can be positioned at the periphery 48 of the sole plate 28 where it merges smoothly with the bottom 34 of the cylindrical side wall 30.

In FIGS. 9–12 a further preferred embodiment of the present invention of the base-cup 20 is illustrated which includes as a limit means 40 a ring 50 situated approximately half way between the center and the periphery 48 of plate 28, and upwardly extending dimple 58 is present at the center of the sole plate 28. A plurality of vent holes 46 are positioned immediately inside the periphery 48 upon which the base-cup rests. The central portion 60 of sole plate 28 is elevated above the periphery 48 but is still positioned so as to permit a substantial amount of free expansion of the center of the bottle bottom to which the base-cup is applied.

Figure 9:
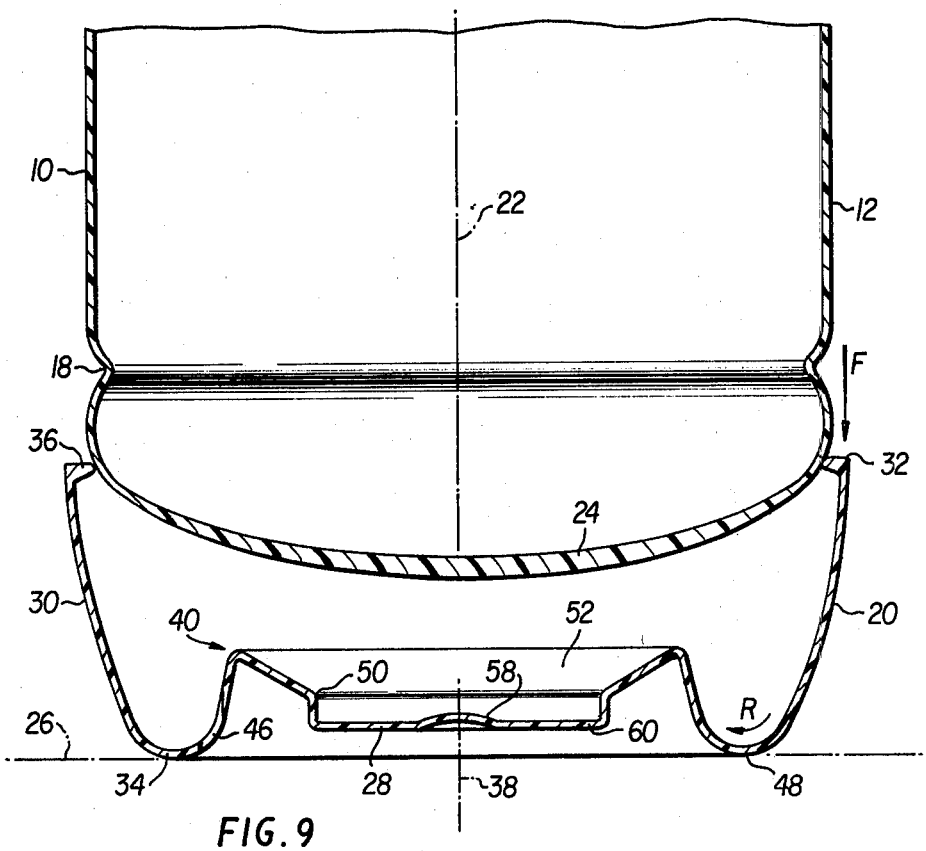
FIG. 9 and 10 is an illustration of another embodiment of a base-cup according to the present invention featuring a displacable outer peripheral sole plate edge when experiencing bottle insertion loading.
Figure 10:
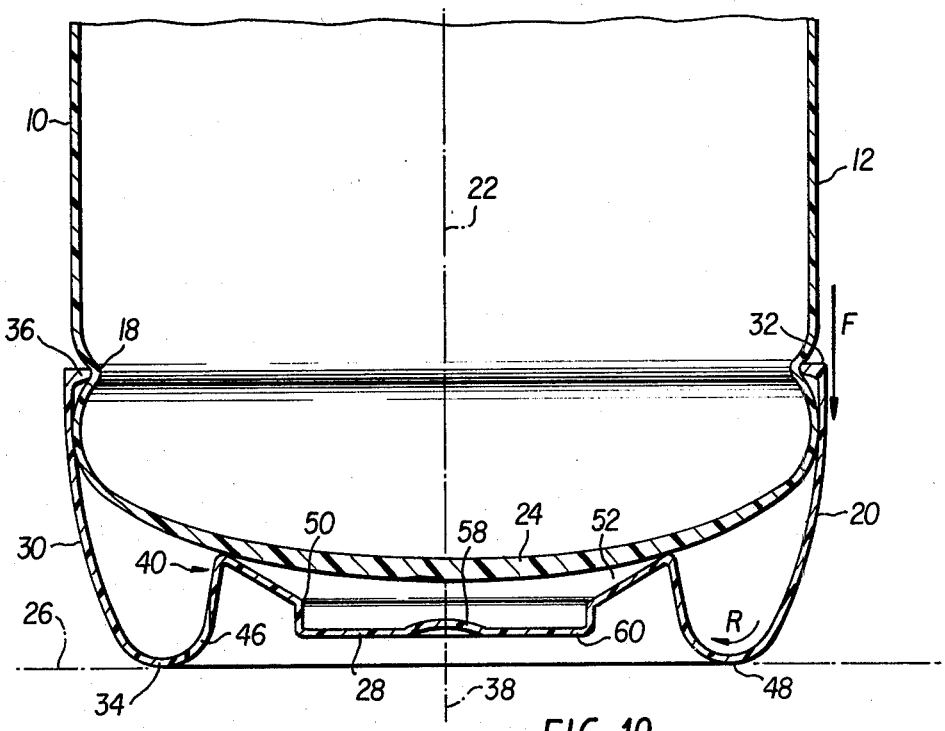

When a bottle is inserted into the base-cup as illustrated in FIGS. 9 and 10, a downward force F is presented substantially uniformly around the cylindrical wall 30 of the base-cup 20 due to the interaction of the bead 36 with the semi-hemispherical bottle bottom. This force causes a slight inward rolling in the direction R of the bottom edge 34 of the side wall 30 thereby elevating surface 52 of ring 50. As shown best in FIG. 10, the elevated surface 52 in turn interacts with the bottom of the bottle so as to prevent the insertion of the bottle any substantial distance beyond that position where the bead 36 engages the radial indentation 18 of the bottle.

Figure 11:
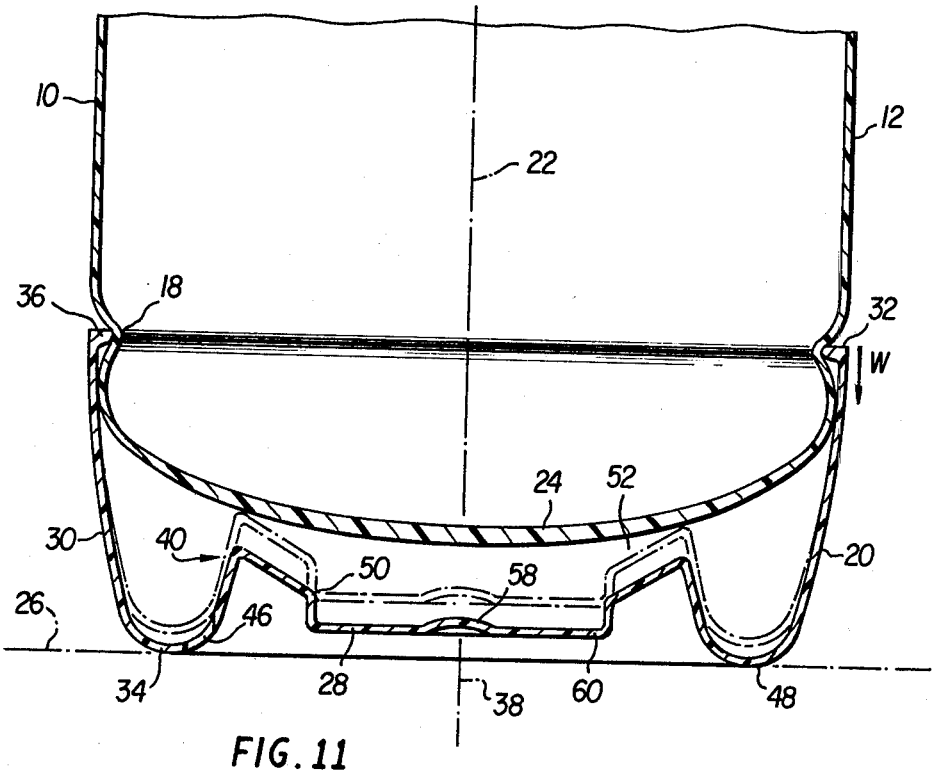
FIG. 11 is a sectional view of the embodiment illustrated in FIGS. 9 and 10 in a "relaxed" position after bottle insertion.

After the bottle is inserted in place, the weight of the bottle, even with its contents, represent a much smaller downward force W than the original insertion force F. The lower surface 34 of the cylindrical side wall therefore returns substantially to its original undisplaced position, and surface 52 of the limit means 40 likewise returns to its original position, as shown in FIG. 11, so as to permit the free expansion of the bottle bottom.

Figure 12:
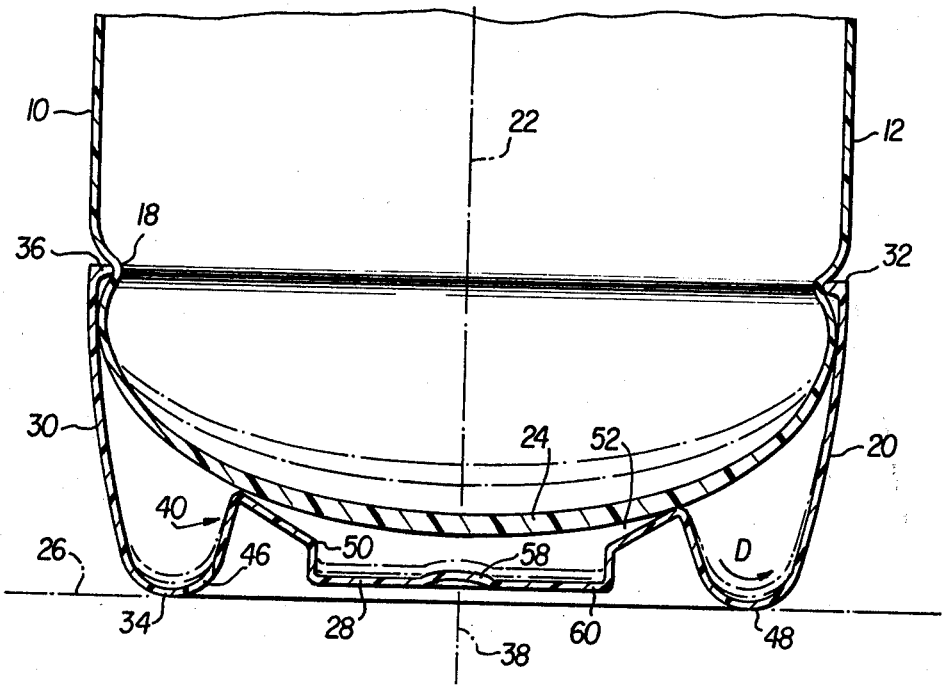
FIG. 12 is a sectional view of the base-cup shown in FIG. 11 experiencing deformation due to axial elongation of the bottle to which the base-cup is attached.

Under extreme circumstances, where the bottle bottom axially extends an unusual amount due to unusually high pressures within the bottle as shown in FIG. 12, the surface 52 of the ring 50 will be contacted by the bottle bottom, and displaced downwardly. In this circumstance, the periphery 48 of the base-cup 20 is similarly displaced out and down in the direction D, thus maintaining a stable supporting surface for the combined bottle 10 and base-cup 20. This proportional downward and outward displacement of the sole plate periphery 48 with respect to the bead 36 thus serves the added advantage of maintaining the stable configuration of the bottle even under extreme high pressure circumstances that might otherwise be unacceptable with base-cups having designs according to the prior art.

It will be appreciated by those of ordinary skill in the art that the foregoing description of preferred embodiments is but illustrative and that other configurations within the scope of the following claims might be created incorporating fully equivalent features achieving substantially the same results as those discussed in the foregoing specification.

I claim:

1. A base-cup for supporting a bottle in an upright position, the bottle having a semi-hemispherical bottom and having a radial indentation in a lower portion of its otherwise generally cylindrical body, the base-cup comprising:

(a) a sole plate, (b) a cylindrical side wall having an open top edge and a bottom edge smoothly merging into the sole plate, (c) an annular bead on the inside of the top edge for engaging the radial indentation of the bottle body, and (d) limit means for preventing the over-insertion of the bottle into the base-cup, the limit means comprising at least three circumferentially equally spaced and radially extending fillet webs joined to the side wall of the base-cup.

2. The base-cup of claim 1 wherein each of said fillet webs is solid.

3. The base-cup of claim 1 wherein each of said fillet webs is hollow, there being a hollow present in a lower portion of the side wall and an outer portion of the sole plate corresponding to each fillet web.

4. The base-cup of claim 1 wherein the interior surface of each of said fillet webs is concave.

5. A base-cup for supporting a bottle in an upright position, the bottle having a semi-hemispherical bottom and having a radial indentation in a lower portion of its otherwise generally cylindrical body, the base-cup comprising:

(a) a sole plate, (b) a cylindrical side wall having an open top edge and a bottom edge smoothly merging into the sole plate, (c) an annular bead on the inside of the top edge for engaging the radial indentation on the bottle body, and (d) limit means projecting upward from the sole plate into the interior of the base cup for preventing the over-insertion of the bottle into the base-cup, the limit means being normally downwardly spaced from the bottle bottom yet in sufficient proximity to contact the bottle bottom if the bottle is inserted significantly beyond the point of engagement of said annular bead and said radial indentation on the bottle bottom.

6. The base-cup of claim 5 wherein the limit means comprises a ring situated approximately half way between the center of the sole plate and the cylindrical sidewall.

7. The base-cup of claim 6 wherein the ring is hollow, there being a hollow present in the lower surface of the sole plate corresponding to the ring.

8. The base-cup of claim 6 wherein the sole plate periphery is flexible whereby the ring can be displaced upwardly and downwardly with respect to the open top edge of the side wall, the displacement causing respectively a corresponding proportional upward and inward, and downward and outward, displacement of the sole plate periphery.

9. A base-cup for supporting a bottle in an upright position, the bottle having a semi-hemispherical bottom and having a radial indentation in a lower portion of its otherwise generally cylindrical body, the base-cup comprising:

(a) a sole plate;

(b) a cylindrical side wall having an open top edge and a flexible bottom edge smoothly merging into the sole plate, (c) an annular bead on the inside of the top edge for engaging the radial indentation on the bottle body, and (d) a ring situated approximately half way between the center of the sole plate and the cylindrical sidewall, and projecting upward from the sole plate into the interior of the base-cup a distance insufficient to normally contact the bottle bottom yet sufficient to contact the bottle bottom if the bottle is inserted significantly beyond the point of engagement of said annular bead and said radial indentation of the bottle body.

10. A method of ensuring stable vertical alignment of the bottle having a semi-hemispherical bottom comprising the steps of:

(a) providing a bottle having a semi-hemispherical bottom with a radial indentation in a lower portion of the otherwise generally cylindrical body of the bottle;

(b) providing a base-cup for supporting the bottle with a sole plate, a cylindrical side wall having an open top edge and a bottom edge smoothly merging into the sole plate, an annular bead on the inside of the top edge for engaging the radial indentation of the bottle body, and limit means projecting upward from the sole plate into the interior of the base-cup for preventing the over insertion of the bottle into the base-cup;

(c) axially aligning the open top of the base-cup with the semi-hemispherical bottom of the bottle;

(d) telescopically moving the base-cup and bottle together along a common axis until the annular bead of the base-cup is received in the radial indentation of the bottle body, the limit means preventing the insertion of the bottle into the base-cup significantly beyond the point of bead-indentation engagement; and (e) releasing any axial pressure on the base-cup and bottle combination due to the relative telescopic movement therebetween whereby the limit means assumes a position downwardly spaced from the bottle bottom.

* * * * *